US005882038A

United States Patent [19]

Ong

[11] Patent Number: 5,882,038

[45] Date of Patent: Mar. 16, 1999

[54] CUSTOM PRESENTATION FOLDER

[76] Inventor: Bon S. Ong, P.O, Box 4247, Torrance, Calif. 90510

[21] Appl. No.: 687,078

[22] Filed: Jul. 17, 1996

[51] Int. Cl.[6] ..... B42F 7/04

[52] U.S. Cl. ..... 281/31; 402/3; 402/79; 402/80 R; 281/38

[58] Field of Search ..... 281/2, 5, 31, 38; 402/3, 79, 80 R

[56] References Cited

U.S. PATENT DOCUMENTS

| | | | |
|---|---|---|---|
| 2,852,275 | 9/1958 | Brook | 402/3 |
| 4,863,093 | 9/1989 | Ducorday . | |
| 4,971,361 | 11/1990 | Whiting | 281/5 |
| 5,042,843 | 8/1991 | Kuhns et al. | 283/72 X |
| 5,090,732 | 2/1992 | Kuhns et al. | 281/31 X |
| 5,215,398 | 6/1993 | White et al. | 402/73 |
| 5,468,085 | 11/1995 | Kline | 402/79 |

FOREIGN PATENT DOCUMENTS

| | | | |
|---|---|---|---|
| 3221679 | 12/1983 | Germany | 402/3 |
| 683411 | 3/1994 | Switzerland | 402/3 |

*Primary Examiner*—Frances Han
*Attorney, Agent, or Firm*—Charles H. Thomas

[57] ABSTRACT

A document folder is constructed so as to allow an individualized title to be custom made for use with a folder formed of a sheet of stiff cover stock that is folded to delineate front and back covers. The front cover of the folder is formed with at least a title viewing window defined therethrough. A stiff title backing of a size no greater than the front cover is engaged with the front cover so that the backing is disposed immediately behind the front cover. The backing may be formed as an extension flap of the stock from which the front and back covers are formed, or it may be a separate structure inserted into a pocket behind the front cover. In either case a title sheet is preferably provided and the backing is equipped with means for releasably holding the title sheet in contact with the interior surface of the front cover and in contact with the backing. A title is printed on the title sheet so that when the title sheet is secured to the backing, and the backing is in turn secured to the front cover, the printed title on the title sheet is visible through the title viewing window from the exterior surface of the front cover.

10 Claims, 5 Drawing Sheets

CUSTOM PRESENTATION FOLDER

BACKGROUND OF THE INVENTION

1. Field of the Invention

The present invention relates to a document folder upon which the title or other printed matter visible from the exterior of the folder may be changed.

2. Description of the Prior Art

In business and industry many sales are made to prospective customers utilizing documents in the nature of business proposals, customized sales proposals, or other documents intended for presentation to specific businesses or governmental organizations. In presenting proposals of this type it is quite desirable to identify the document as having been prepared especially for presentation to a specific entity. This may best be done by including the name or other identifying indicia of the entity for whom the document is intended for presentation on the front cover of the document.

This practice has several advantages. By printing the name of the entity for which the proposal has been prepared on the cover, it becomes apparent to the decision making individuals within that entity that some time and effort has been spent in considering the specific needs and requirements of the entity for which the proposal has been prepared. That is, it is apparent that the proposal is not just a general item of promotional material that would be given to any prospective business customer. The entity preparing and presenting such a customized proposal is therefore more likely to have greater credibility in the minds of the decision-making individuals receiving the proposal insofar as the perceived depth of understanding of the unique needs and requirements of the receiving entity are concerned.

The use of an individual title of the intended recipient of a business proposal also has advantages to individuals dealing with the proposal document on behalf of the entity preparing and presenting the document. A title identifying the intended recipient of the intended proposal serves to differentiate the particular form and substance of a proposal prepared for one intended recipient from similar, yet somewhat different, variations of the proposal that may have been prepared for presentation to other intended recipients. Thus, a unique title that is visible even before the proposal folder is opened ensures that the presenting individual brings to the intended recipient only those copies of a general presentation approach that have been uniquely modified for a particular intended recipient.

One difficulty in customizing document folders for use with particular intended recipients is the relatively great expense of printing a title on a cover of a single or a small number of document folders. According to conventional construction techniques, documents folders are typically formed from a single, die-cut sheet of thick paper or card stock. Once cut, the sheets of card stock are folded according to particular patterns. In the simplest form a folder may be merely creased in half to form a stiff front and back cover joined to each other by a spine fold demarcation. However, often the sheet of stock from which the folder is formed is cut so as to additionally define reinforcement margins, pockets, and sometimes interior binding folds. In any event, the die-cut sheet of stock in its flat form before folding is typically significantly larger than a standard sheet of paper, which may be eight and a half by eleven inches, eight and a half by thirteen inches, eight and a half by fourteen inches, or A4 size.

At present, most conventional computer-operated printers are designed to receive only standardized sizes of stock having the dimensions of typical, standard size, paper sheets. As a consequence, a document folder cannot be fed through a conventional computer-operated printer, such as a laser printer, in its unfolded form because the flattened sheet of stock is simply too large to pass through the printer. On the other hand, once the sheet of stock is folded to define the covers and possibly pockets within a folder, the folded sheet of stock is too thick to pass through a conventional, computer-operated printer. As a consequence, folders can only be printed on their surfaces with special purpose, expensive printing machines. While it may be economical to print a large number of folders with the same title on such special purpose printing machines, the economic cost of printing only a small number of folders using such special-purpose printing machines ordinarily cannot be justified.

One approach to providing a document with a title indicating the intended recipient is to package the presentation materials within a folder having a transparent front cover. The title is then printed on the top page of the documents within the folder and the contents of the folder are then bound between the covers. Since the top cover is transparent, the title of the presentation materials is visible through the transparent front cover. Because the title is printed on the top sheet of a standard size sheet of paper, it can easily pass through a conventional, computer-operated printer which can print small quantities of documents economically. However, a folder of this type is disadvantageous in that it lacks the pockets that can be easily created using a card stock or stiff paper stock sheet of material in the folder construction. Also, the cost of the transparent cover adds to the expense of the folder. Furthermore, the transparent material forming the cover is often considerably less stiff than the thick paper stock or card stock material employed to form conventional presentation folders.

Another approach to providing a card stock or thick paper stock folder with a customized cover is to form a window in the front cover and to position a sheet of paper bearing the title within the folder as the top sheet in a stack of presentation materials. The title on this sheet is thereby visible through the title window formed in the cover. However, quite often materials within the folder become rearranged so that the title page is covered up by other sheets which should be located behind the title page. As a consequence, printed material that clearly is not a title will often erroneously appear in the title window in the front cover. This greatly detracts from the impression created by the presentation folder since instead of appearing as a document entitled for and carefully prepared for use by a particular entity, the folder appears to encase a disorganized assemblage of materials.

Still another approach to providing a card stock or thick paper stock folder with a title is to print the title on a title label, and to attach the label, typically by means of adhesive, to the exterior surface of the front cover. While title labels of this type can be printed economically in this way, the use of a label attached adhesively to the front cover renders the folder less professional in appearance. Also, the use of adhesive labels adds an additional step to the assembly of the folder, since the adhesive label must be activated, either by pressure or moisture, and pressed against the exterior surface of the cover. This additional step is normally performed manually. As a result, placement of a label crooked or in a nonuniform manner on several copies of the presentation materials is not uncommon.

SUMMARY OF THE INVENTION

One object of the present invention is to provide a document folder that may be constructed of stiff card stock or thick paper stock so as to protect the contents of the folder, and also provide the cover with a customized title that is visible from the exterior of the folder when the folder covers are closed. A related object of the invention is to provide a document folder having a title visible in this manner in which only a limited number of copies of documents having the same title can be produced economically. This object is achieved by forming the folder with a title viewing window and providing the folder with a title sheet that is visible through the window, yet which is also attached to the inside of the front cover of the folder.

Another object of the invention is to provide a stiff card stock or paper stock folder with a title using die-cut card stock folders that are highly versatile for use with an innumerable number of different recipients, but with a customized title sheet attached to the folder without adhesives yet in such a manner as to be securely, yet releasably attached to the inside of the front cover.

A further object of the invention is to provide a presentation folder constructed of card stock or thick paper material with a title that can be firmly, yet releasably engaged with the folder cover without the use of adhesives, yet in a manner such that the title always remains positioned centered within the title viewing window.

A further object of the invention is to create a document folder from card stock or stiff paper stock and to provide such a folder with a title that can be installed rapidly and which will remain precisely in position once installed. Moreover, the title can be releasably installed so that the same basic folder structure can be provided with any number of different interchangeable, individually customized titles very rapidly.

A further object of the invention is to provide a document folder with a title that remains in position visible from the exterior surface of the front cover regardless of whether the folder is opened or closed. The title sheet bearing the title is visible in all cases through a title window in the front cover. Furthermore, the title sheet may be conveniently held in position by a title backing which may be quickly and easily engaged with the front cover of the folder. Moreover, it is a simple matter to change the title of a particular folder by merely removing and replacing the title sheet.

These and other objects of the invention will become readily apparent to those familiar with the construction and use of office supplies.

In one broad aspect the present invention may be considered to be a custom presentation folder for holding documents. The folder of the invention is comprised of stiff, front and back folders hinged together and both having mutually facing interior surfaces and opposite exterior surfaces. The front cover has a title viewing window defined therethrough entirely within its perimeter. A flat, stiff title backing is provided which is no greater in area than the front cover. In addition, some mounting means is provided on the front cover for releasably holding the title backing in a disposition facing the interior surface of the front cover. A flat title sheet may be interposed between the front cover and the backing and has printing thereon that is visible through the title viewing window in the front cover from the exterior surface thereof. Alternatively, if the title backing is formed as a structure separate from the structure forming the front and back covers, the title may be printed directly on the backing structure.

Several different embodiments of the invention are possible. For example, the mounting means may be comprised of a pocket located on the interior surface of the front cover. The backing may then be removably disposed in the pocket. If a separate title sheet is utilized, it is mounted in a fixed position relative to the backing by means of title sheet retainers on the backing that releasable hold the title sheet in a predetermined position on the backing.

The backing has at least one pair of opposing title sheet mounting edges, and preferably is rectangular in shape. The title sheet retaining means is then preferably comprised of a separate incision through the structure of the backing proximate each of the opposing mounting edges. Incisions define widely separated title sheet retaining tabs that are directed toward each other. The title sheet is disposed against the title backing and is mounted thereto beneath the title sheet retaining tabs.

In another embodiment the title backing and the front cover may be both formed as folding panels delineated by a backing hinge fold on a single sheet of flat stock, such as card stock or stiff paper stock. In this arrangement the backing has at least one pair of opposing title sheet mounting edges and the title sheet retaining means is comprised of a separate incision through the structure of the backing sheet proximate each of the opposing title sheet mounting edges in the pair. The incisions thereby define widely separated title sheet retaining tabs that are directed toward each other. The title sheet is disposed against the backing and beneath the title sheet retaining tabs.

The mounting means may also be comprised of at least one incision through the structure of the front cover remote from the backing hinge fold. The incision defines a latching tab from the structure of the front cover. The title backing extends beneath the latching tab and is held by it against the interior surface of the front cover.

In another broad aspect the invention may be defined as a document folder comprising a sheet of stiff cover stock folded at a spine to form a back cover and also a front cover that has an exterior surface and an interior surface. The front cover defines a title window through its structure. A stiff title backing of a size no greater than the front cover is engaged with the front cover so that the backing is disposed immediately behind the front cover between the front and back covers. A title sheet having a title printed thereon may also be provided. In addition, a title display means is required for releasably holding the title sheet in contact with the interior surface of the front cover and in contact with the backing. In this way the title on the title sheet is visible through the title window from the exterior surface of the front cover.

In still another broad aspect the invention may be defined as a document folder comprising a sheet of stiff cover stock folded to define front and back covers hinged together at a spine. The front cover has an exterior surface and an opposite interior surface. At least one window is defined through the front cover entirely within the perimeter of the front cover. A stiff, flat title backing is provided which is no greater in size than the front cover. A backing retention means is also provided for releasably holding the title backing in juxtaposition facing the interior surface of the front cover. A printed title sheet is interposed between the interior surface of the front cover and the backing. The printed title sheet has printed matter thereon which is visible through the at least one window in the front cover from the exterior surface thereof.

Preferably the title backing is rectangular in configuration and has an interior region bounded within pairs of mutually parallel edges. The document folder is further comprised of title sheet mounting tabs located proximate both edges in at least one of the pairs of edges of the backing. The title sheet mounting tabs are directed toward the interior region of the backing and toward each other. The title sheet mounting tabs releasably capture the printed title sheet and hold it against the interior region of the backing. The title sheet mounting tabs are preferably formed by incisions through the structure of the backing. As a result, the title sheet mounting tabs are defined from the structure of the backing and are resiliently deflectable outwardly from the remaining structure of the backing.

In some embodiments of the invention the front cover defines a business card window therethrough, as well as a title window. In such an arrangement a business card may be mounted on the title sheet at a location thereon such that it is visible through the business card window from the exterior surface of the front cover when the title sheet is held in contact with the interior surface of the front cover.

The invention may be described with greater clarity and particularity by reference to the accompanying drawings.

DESCRIPTION OF THE EMBODIMENTS

Figure 1:
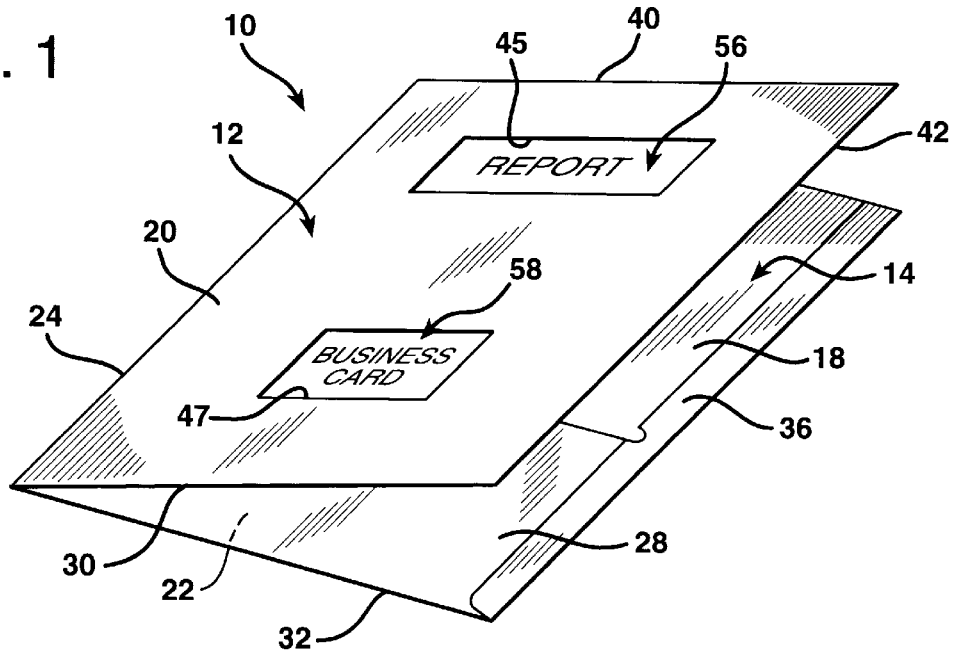
FIG. 1 is a perspective view of one embodiment of a document folder constructed according to the invention.

FIG. 1 illustrates a document folder 10 which may be a business proposal presentation folder. The document folder 10 is formed of a single, flat sheet of card stock or thick paper stock that is die cut to define a front cover 12 and a back cover 14. The front cover 12 and the back cover 14 are both rectangular in shape and have mutually facing interior surfaces 16 and 18, visible in FIG. 4, and opposite exterior surfaces 20 and 22, respectively. The front and back covers 12 and 14 are hinged together at a longitudinal fold in the card stock that defines a spine 24 that forms a spine hinge between the front cover 12 and the back cover 14.

The stiff card or paper stock from which the front cover 12 and back cover 14 are formed is also die cut so as to define a folding flap that forms a pocket 26 on the inside surface of the front cover 16 and another folding flap that forms a pocket 28 on the inside surface of the back cover 14. The pockets 26 and 28 are formed by the flaps which fold upwardly along the lower edges 30 and 32 of their respective covers 12 and 14. The sheet of stock also is die cut to define marginal edge strips 34 and 36 on the edges of the front cover 12 and back cover 14, respectively. The edge strips 34 and 36 reinforce the edges of the covers 12 and 14 opposite their hinge connection to each other at the spine 24, and also close the outside edges of the pockets 26 and 28.

The front cover 12 is formed in a rectangular configuration. The lower edge 30 of the front cover 12 is parallel to an opposite, upper edge 40. The spine 24 forms the laterally inner edge of both the front cover 12 and the back cover 14. The laterally outer edge 42 of the front cover 12 is formed along the fold line of the marginal edge strip 34.

A pair of rectangular windows 45 and 47 are defined through the structure of the card stock entirely within the perimeter of the front cover 12. The upper window 45 is a title viewing window that has larger dimensions than the smaller business card viewing window 47 located therebeneath. Both of the windows 45 and 47 lie between the pairs of mutually opposing edges 30, 40 and 24, 42.

The areas encompassed within the perimeters of the front and back covers 12 and 14 are equal to each other and are each slightly larger than standard sizes of paper commonly used for preparation of reports or other presentation documents. The front cover 12 may measure eleven and three-quarter inches between the mutually parallel top and bottom edges 30 and 40 and nine and seven-sixteenths inches between the laterally interior and laterally exterior edges 24 and 42. The dimensions between the corresponding edges of the back cover 14 are identical to those of the front cover 12. When formed in this manner the pockets 26 and 28 are wide enough to receive therewithin sheets of paper cut to the standardized size of eight and one-half by eleven inches. Such sheets of paper can readily be inserted lengthwise into the open tops of the pockets 26 and 28.

Unlike conventional document presentation folders, the folder 10 also includes a backing 44 formed of a stiff sheet of card stock or thick paper stock material, and also a title sheet 46 formed of much thinner paper. The backing 44 is die cut to define mutually parallel lower and upper edges 48 and 50 respectively, and mutually parallel, laterally opposing edges 52 and 54.

The size of the die cut sheet forming the backing 44 is slightly greater than the size of the title sheet 46. For example, the backing 44 may be eleven and a half inches in length between the bottom and top edges 48 and 50 and eight and nine-sixteenths inches in width between the lateral side edges 52 and 54. In any event, the title backing 44 is of a size no greater than the size of the front cover 12.

The title sheet 46 may be a standard eight and a half by eleven inch size sheet of paper, typically either sixteen or twenty pound weight. Because the title sheet 46 is somewhat shorter in length than the backing 44, it can be positioned to lie well within the lower edge 48 and the upper edge 50 of the backing 44.

Figure 2:
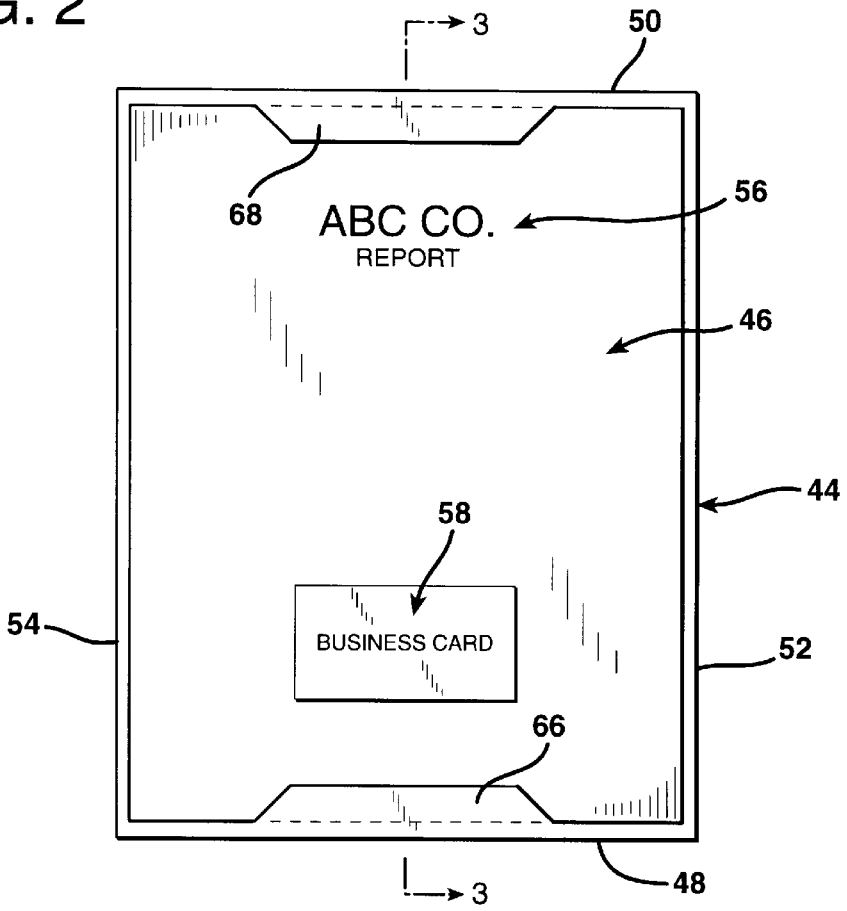
FIG. 2 is a front elevational view of the backing with the title sheet mounted thereon that is employed in the document folder of FIG. 1.

As is evident is FIG. 2, the title sheet 46 has a customized title 56 printed thereon. The title 56 is uniquely associated with the intended recipient of the document folder 10. Because the customized title 56 is printed on the relatively thin, standard size title sheet 46, it can be created using a conventional, computer-operated printer, such as a laser printer. This allows a small number of title sheets, indeed possibly only a single title sheet, to be printed economically.

The title sheet may also be provided with a conventional business card 58. The business card 58 may be of any size, but the size of the business card 58 is selected such that it is clearly visible through the business card window 47, as illustrated in FIG. 1. The business card 58 is preferably detachably connected to the exposed surface of the title sheet 46. For example, it may be attached by a folded loop of adhesive tape disposed between the business card 58 and the exposed surface of the title sheet 46. Alternatively, the business card 58 may be releasable attached to the title sheet 46 by means of diagonal die cuts in the title sheet 46 located proximate to the positions of the corners of the business card 58, so that the corners of the business card 58 fit through the diagonal die cuts and hold the business card 58 in position against the exposed face of the title sheet 46.

The shorter opposing and mutually parallel lower and upper edges 48 and 50 of the rectangular backing 44 serve as title sheet mounting edges in the embodiment of the invention illustrated in FIGS. 1 through 4. The title display means of the invention includes title sheet mounting incisions 60 and 62 formed through the structure of the backing 44 and within the boundaries thereof defined by the edges 48, 50, 52, and 54. The title sheet mounting incisions 60 and 62 are located adjacent to the mutually parallel title sheet mounting edges 48 and 50, respectively. Each of the title sheet mounting incisions 60 and 62 has a central portion 64 that extends parallel to a proximate one of the mutually parallel title sheet mounting edges 48 and 50. The end portions of the title sheet mounting incisions 60 and 62 extend diagonally from the opposite ends of the central portion 64 toward the nearest title sheet mounting edge. However, the ends of the title sheet mounting incisions 60 and 62 terminate short of the title sheet mounting edge 48 or 50 located most proximate thereto.

The title sheet mounting incisions 60 and 62 thereby define title sheet mounting tabs 66 and 68. The title sheet mounting tabs 66 and 68 are formed by the incisions 60 and 62 through the structure of the backing 44 and are defined from the structure of the backing 44. Each of the title sheet mounting tabs 66 and 68 has a configuration generally in the shape of a trapezoid.

Figure 3:
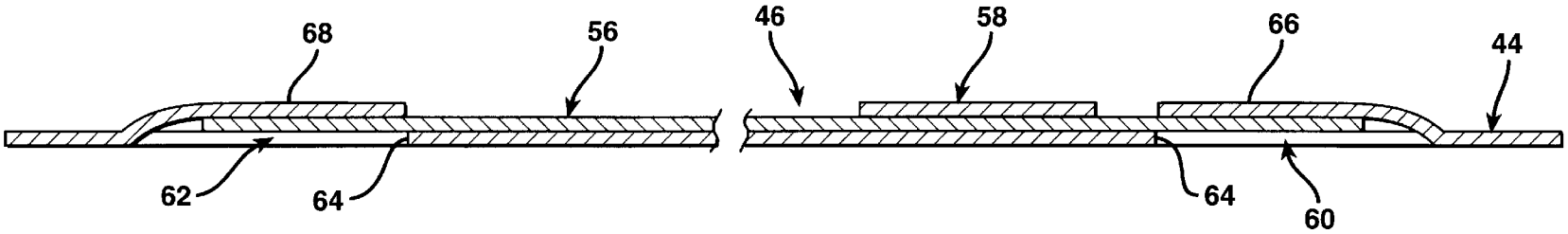
FIG. 3 is a sectional view taken along the lines 3—3 of FIG. 2.
Figure 8:
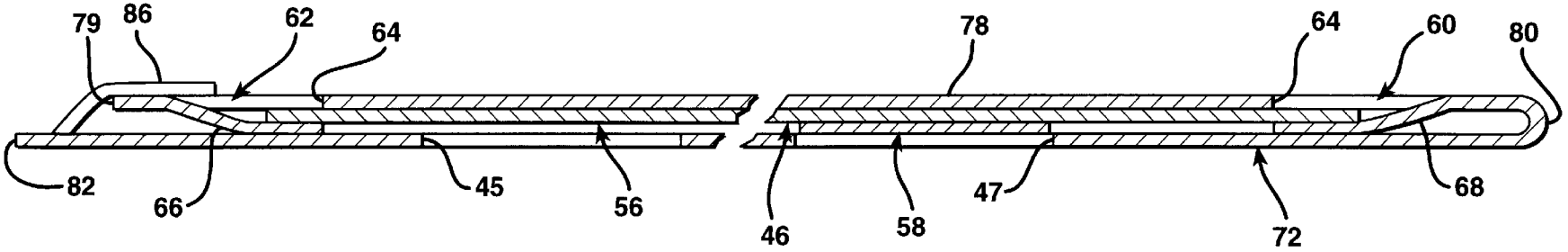
FIG. 8 is a sectional view taken along the lines 8—8 of FIG. 7.

The backing 44 forms a generally planar structure. The title sheet mounting tabs 66 and 68 are resiliently deflectable outwardly from the plane of the remaining structure of the backing 44, as best illustrated in FIG. 3. The title sheet mounting tabs 66 and 68 are directed toward each other and thereby capture within their embrace the bottom and top edges of the title sheet 46.

Figure 4:
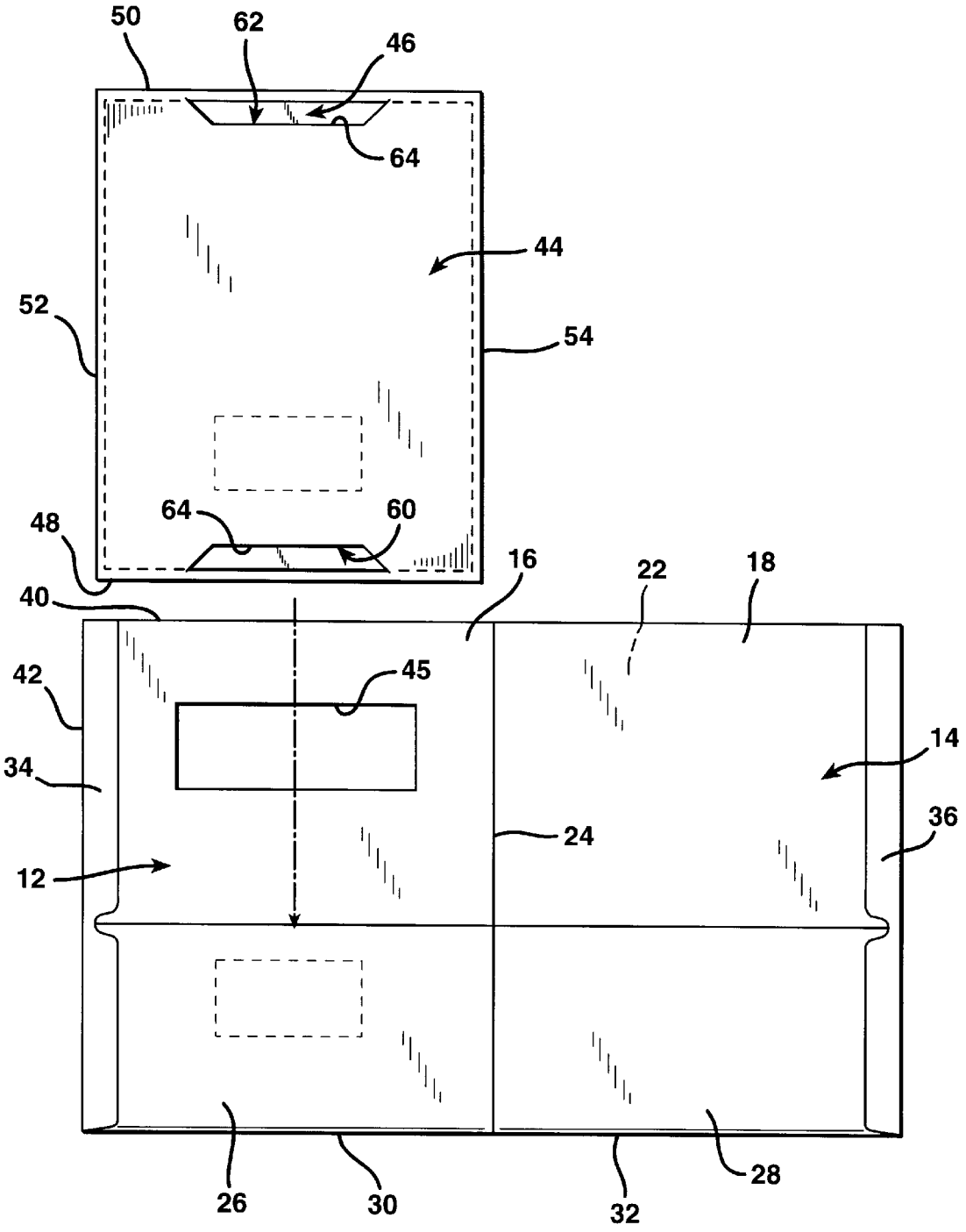
FIG. 4 illustrates the assembly of the backing and title sheet with the front cover of the folder shown in FIG. 1.

The assembly of the folder 10 illustrated in FIG. 1 is best depicted in FIGS. 2, 3, and 4. Specifically, a title sheet 46 of a standard size paper is imprinted with a unique title 56 identifying the entity for which the document folder 10 has been prepared using a computer-controlled laser printer. After the title 56 has been printed the title sheet 46 is mounted on the backing 44 by lifting the resilient title sheet mounting tabs 66 and 68 out of the plane of the remaining portion of the backing 44 and inserting the title sheet 46 face up so that the title 56 faces outwardly away from the backing 44. The title sheet retaining tabs 66 and 68 are thereupon released so that the title sheet 46 is held securely, but removably, within the confines of the backing 44. At this point the business card 58 may be attached to the title sheet 56 at a location thereon normally indicated by printed indicia, atop which the business card is placed.

The backing 44, with the title sheet 46 secured thereto as shown in FIG. 2, is then inserted into the pocket 26 on the interior surface 16 of the front cover 12 with the title sheet 46 facing the interior surface 16 of the front cover 12. The title 56 and the business card 58 are positioned on the title sheet 46 at locations such that when the backing 44 is fully seated in the pocket 26, with the lower edge 48 of the backing 44 residing closely adjacent to the lower edge 30 of the pocket 26, the title 56 on the title sheet 44 will be in aligned registration with the title viewing window 45. At the same time, the business card 58 will reside in registration and is visible through the business card viewing window 47. Both the title 56 and the business card 58 are thereby visible through their respective viewing windows from the exterior surface 20 of the front cover 12 when the title sheet 46 is held in contact with the interior surface of the front cover 12.

It is evident that even with the front cover 12 opened, the title sheet 46 will remain in position such that the title 56 can be viewed through the title viewing window 45 and the business card 58 remains visible through the business card viewing window 47. The cooperation of the backing sheet 44 in mounting the title sheet 46, and the removable insertion of the backing sheet 44 into the pocket 26 maintains the title 56 in a position in which it can always be viewed from the exterior surface 20 of the front cover 12.

FIGS. 5 through 8 illustrate an alternative embodiment of the invention. The document folder 70 shown in FIGS. 5 through 8 is formed with a rectangular front cover 72 and back cover 74 in much the same manner as the covers 12 and 14 depicted in the embodiment of FIGS. 1–4. Like the front cover 12, the front cover 72 has a rectangular title viewing window 45 and a rectangular business card viewing window 46. The back cover 74 has a marginal edge strip 36 that extends along a pocket 76 that is die cut with a diagonal opening. The front and back covers 72 and 74 are folded together along a spine hinge line 24 that serves as the lateral interior edge of both covers. The front cover 72 has a lateral outer edge 75.

The embodiment of FIGS. 5–8 differs from that of FIGS. 1–4 is several important respects, however. Specifically, in the document holder 70 the backing 78 is not formed as a separate structure from the front and back covers 72 and 74. Rather, the backing 78 is formed as a rectangular flap from the same sheet of die-cut stiff paper or card stock as the covers 72 and 74. The backing 78 is permanently attached to the front cover 72 and is delineated therefrom by a linear backing flap demarcation hinge fold 80 that forms the bottom edge of both the front cover 72 and the backing 78 in the finished document holder 70.

The front cover 72 is formed with a top edge 82 that is parallel to and remotely located from its linear bottom edge 80. At least one, and preferably two backing retention tabs 84 and 86 are defined near the top edge 82 of the front cover 72. The backing retention tabs 84 and 86 are formed by a pair of backing interlock incisions 88 formed through the structure of the front cover 72 near the opposite lateral edges 24 and 75 thereof and closely adjacent to the top edge 82 of the front cover 72. Each of the backing interlock incisions 88 is formed with the same configuration, but substantially smaller than the incisions 60 and 62 in the backing illustrated in FIG. 4.

The backing retention tabs 84 and 86 are provided to engage the top edge 79 of the backing 78 that is remote from the backing flap demarcation 80. The length and width of the backing 78 are slightly less than the length and width of the front cover 72. For example, while the front cover 72 may be nine and seven-sixteenth inches in width, the backing 78 is only eight and three-quarter inches in width. Also, while the length of the front cover 72 between its bottom and top edges 80 and 82 may be eleven and three-quarter inches, the length of the backing 78 between its bottom edge 80 and its top edge 79 may be only eleven and one-half inches.

The front cover 72 is rectangular in configuration and has an interior region 73 bounded within pairs of mutually parallel edges 24, 75 and 80, 82. The pair of backing retention tabs 84 and 86 are located proximate the top cover edge 82. The backing retention tabs 84 and 86 are directed away from the top front cover edge 82 and toward the interior region 73 of the front cover 72. The ends of the incisions 88 are all located one-quarter of an inch from the top edge 82 of the front cover 72. As a consequence, the top edge 79 of the backing 78 will fit snugly within the grasp of the backing retention tabs 84 and 86 in the assembled document holder 70. The backing retention tabs 84 and 86 thereby engage the backing 78 at locations remote from the backing flap demarcation fold formed by the bottom edge delineation 80.

As in the embodiment of FIGS. 1–4, the title backing 78 is rectangular in configuration and has an interior region 81 bounded within pairs of mutually parallel edges. Specifically, the region 81 is bounded within the top and bottom edges 79 and 80 and within the lateral side edges 83 and 85. As in the backing of FIGS. 1–4, the backing 78 is provided with title sheet mounting tabs 66 and 68 formed and positioned as previously described. The title sheet mounting tabs 66 and 68 are located proximate to the lower edge 80 and the upper edge 79 of the backing 78 and are directed toward the interior region 81 of the backing 78 and towards each other. This allows the title sheet mounting tabs 66 and 68 to capture the printed title sheet 46 and hold it against the interior region 81 of the backing 78. The title sheet 46 in the document folder 70 can be the same title sheet employed in the document folder 10.

Figure 5:
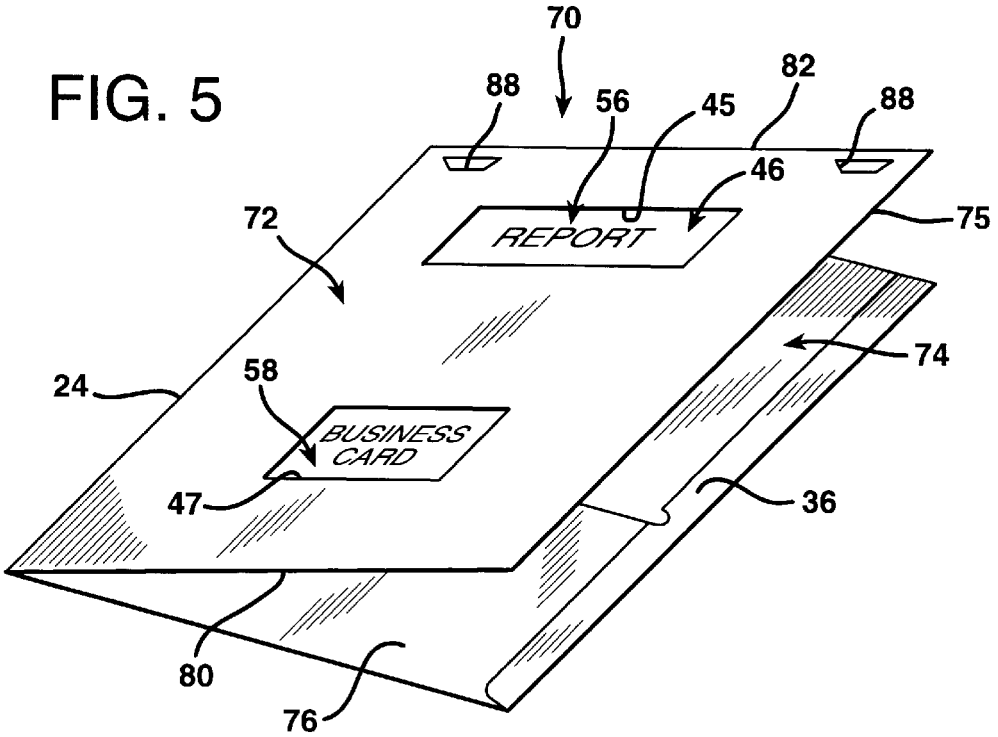
FIG. 5 is a perspective view of an alternative embodiment of a document folder according to the invention.
Figure 7:
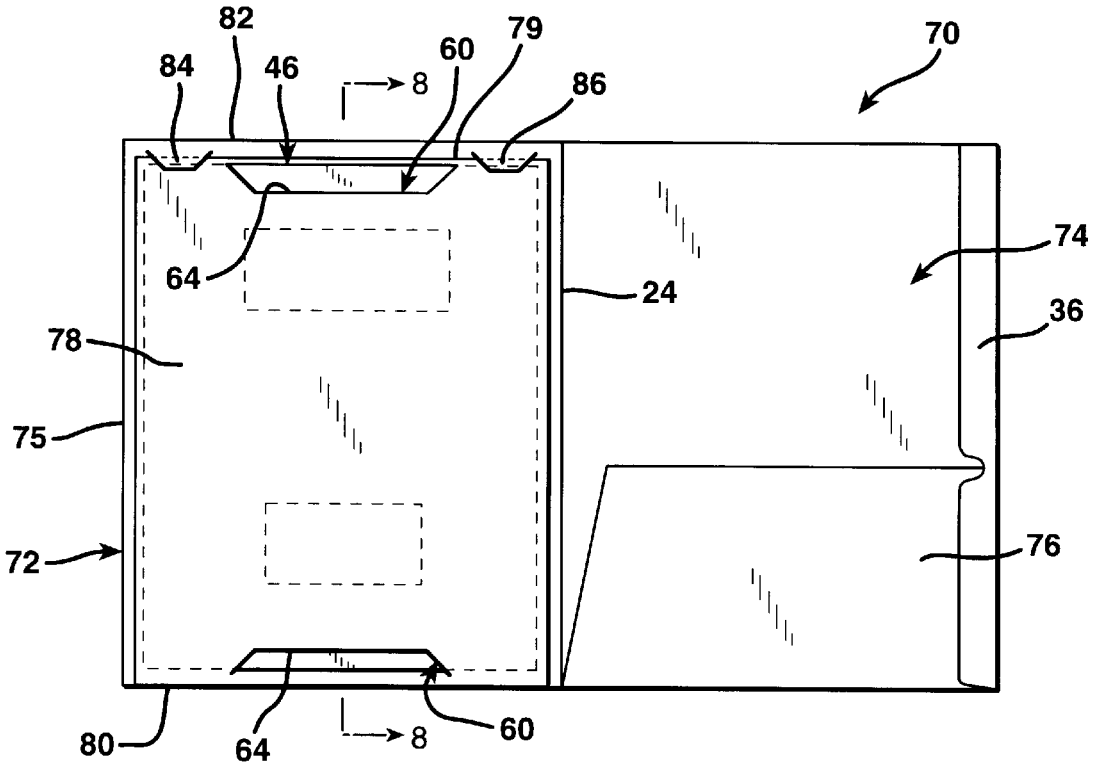
FIG. 7 illustrates the next sequential step in the assembly of the document folder of FIG. 5.
Figure 6:
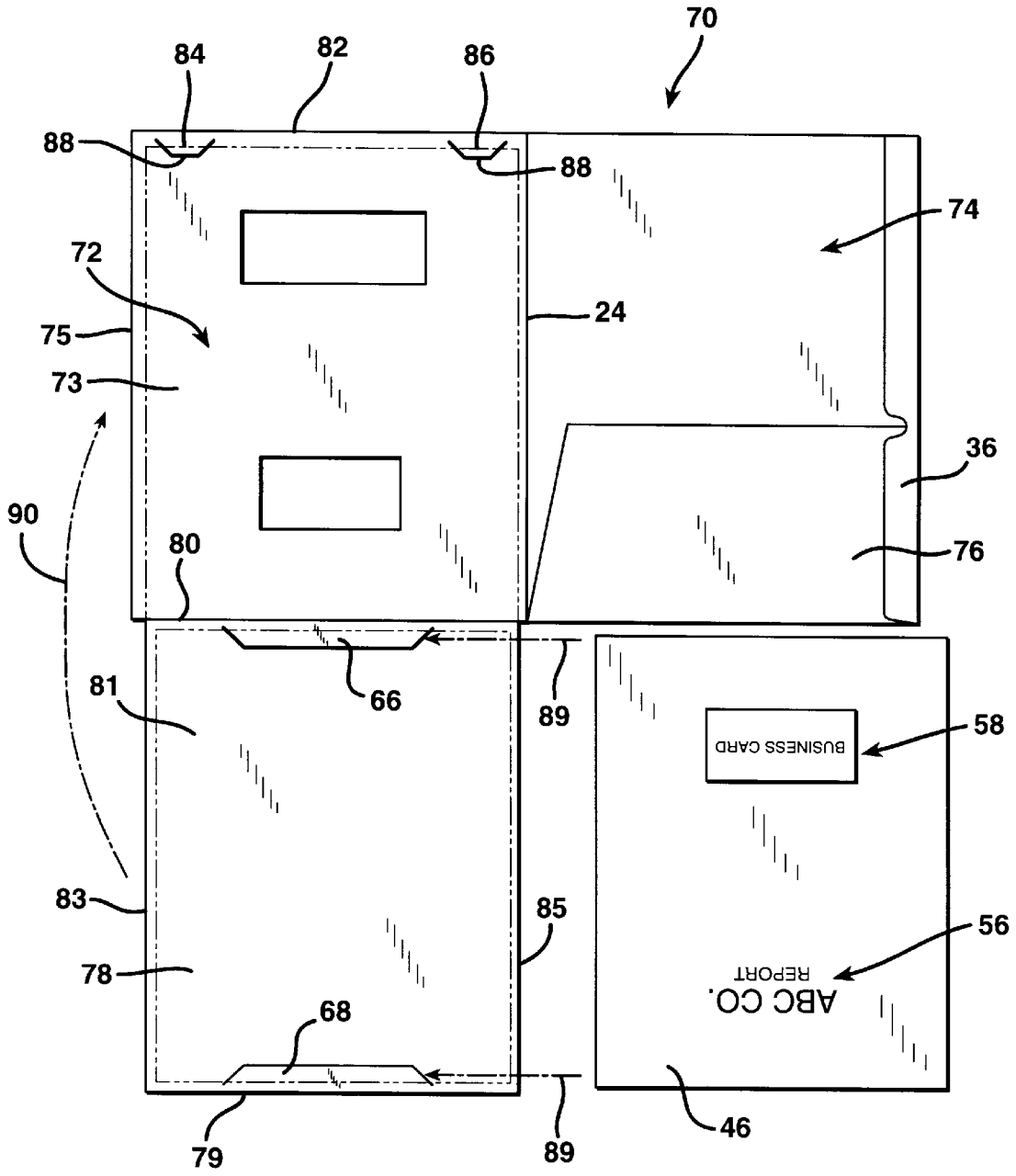
FIG. 6 illustrates an initial step in the assembly of the document folder of FIG. 5.

FIGS. 6 and 7 illustrate the assembly of the document folder 70. As an initial step, the title sheet mounting tabs 66 and 68 are resiliently deflected away from the plane of the backing 78 and the title sheet 46 is inserted therebetween as indicated by directional arrows 89 in the manner illustrated in FIG. 6. With the title sheet 46 captured between the title sheet mounting tabs 66 and 68, the backing 78 is folded about the backing demarcation fold 80 upwardly as indicated by the directional arrow 90 in FIG. 6. This brings the upper edge 79 of the backing 78 into a position in which the backing retention tabs 84 and 86 can be resiliently lifted away from the remaining structure of the front cover 72 so as to allow the upper edge 79 of the backing 78 to be inserted therebeneath. Once the backing retention tabs 84 and 86 are released, they capture the backing 78 with the title sheet 46 facing the interior surface of the cover 72. As in the embodiment of FIGS. 1–4, the title 56 and the business card 58 on the title sheet 46 are respectively aligned with the title viewing window 45 and the business card viewing window 47, as best illustrated in FIG. 5.

Undoubtedly, numerous variations and modifications of the invention are possible. For example, the backing retention tabs 84 and 86 of the document folder 70 need not necessarily be located near the top edge 82 of the front cover 72. They could be positioned proximate the lateral side edges 24 and 75, as long as they are remote from the folding demarcation 80 between the backing 78 and the front cover 72. Also, the backing 78 could be hinged relative to the front cover 72 along the upper edge 82 thereof, or even the lateral edge 75. Also, other means can be provided as a backing retention means. For example, instead of the incisions 88 in the front cover 72, the document folder 70 could be provided with a backing retention flap hinged along the upper edge 82 of the front cover 72, opposite the edge 80 at which the backing 78 is hinged. The backing 78 could then be provided with an incision to receive the interlocking flap folded in across the back side of the backing 78 and inserted through the incision therein.

Other modifications of the invention are also possible. For example, in the embodiment of FIGS. 1–4 the title could be printed directly on the backing 44 so that a separate title sheet is not necessarily required. Accordingly, the scope of the invention should not be construed as limited to the specific embodiments illustrated and described.

I claim:

1. A custom presentation folder for holding documents comprising:

stiff, front and back covers hinged together and both having mutually facing interior surfaces and opposite exterior surfaces and wherein said front cover has a title viewing window defined therethrough entirely within its perimeter; a flat, stiff title backing no greater in area than said front cover and having at least one pair of opposing mounting edges; a flat title sheet interposed between said front cover and said title backing and bearing a title printed thereon; title sheet retaining means on said title backing for releasably holding said title sheet in a predetermined position on said title backing, wherein said title sheet retaining means is comprised of a separate incision through the structure of said backing sheet proximate each of said opposing mounting edges and wherein said incisions define widely separated title sheet retaining tabs that are directed toward each other, and said title sheet is disposed against said title backing and is mounted thereto beneath said title sheet retaining tabs; and mounting means on said front cover for releasably holding said title backing in a disposition facing said interior surface of said front cover so that said title is visible through said title viewing window in said front cover from said exterior surface thereof.

2. A custom presentation folder for holding documents comprising:

stiff, front and back covers hinged together and both having mutually facing interior surfaces and opposite exterior surfaces and wherein said front cover has a title viewing window defined therethrough entirely within its perimeter; a flat, stiff title backing no greater in area than said front cover, wherein said title backing and said front cover are both formed as folding panels from a single sheet of material delineated from each other by a title backing hinge fold on a single sheet of material; a flat title sheet interposed between said front cover and said title backing and bearing a title printed thereon; title sheet retaining means on said title backing for releasably holding said tide sheet in a predetermined position on said title backing, and mounting means on said front cover for releasably holding said title backing in a disposition facing said interior surface of said front cover so that said title is visible through said title viewing window in said flat cover from said exterior surface thereof.

3. A custom presentation folder according to claim 2 wherein said title backing has at least one pair of opposing mounting edges and said title sheet retaining means is comprised of a separate incision through the structure of said title backing sheet proximate each of said opposing mounting edges wherein said incisions define widely separated title sheet retaining tabs that are directed toward each other, and said tile sheet is disposed against said title backing and is mounted thereto beneath said title sheet retaining tabs.

4. A custom presentation folder according to claim 2 wherein said mounting means is comprised of at least one incision through the structure of said front cover remote from said title backing hinge fold and defining a latching tab from the structure of said front cover, and said title backing extends beneath said latching tab and is held by said latching tab against said front cover.

5. A document folder comprising:

a sheet of stiff cover stock folded at a spine to form a back cover and also a front cover, wherein said front cover has an exterior surface and an interior surface and defining a title window opening therethrough, a stiff title backing of a size no greater than said front cover engaged with said front cover so that said backing is disposed immediately behind said front cover between said front and back covers, and said backing has opposing, mutually parallel title sheet mounting edges;

a title sheet bearing a title printed thereon, title display means for releasably holding said title sheet in contact with said interior surface of said front cover and in contact with said backing, whereby said title is visible through said title window from said exterior surface of said front cover, and said title display means includes title sheet mounting incisions formed through the structure of said backing and within the boundaries thereof adjacent each of said mutually parallel title sheet mounting edges and each of said title sheet mounting incisions has a central portion that extends away from a proximate one of said mutually parallel title sheet mounting edges and end portions extending from opposite ends of said central portion toward and terminating short of said proximate one of said mutually parallel title sheet mounting edges, whereby said incisions define tide sheet mounting tabs that are resiliently deflectable outwardly from the remaining structure of said backing.

6. A document folder according to claim 5 wherein said stiff title backing is formed as an extension flap of said cover stock folded over along a linear backing flap demarcation on said cover stock to face said interior surface of said front cover.

7. A document folder according to claim 5 wherein said title display means further comprises at least one backing interlock incision formed through the structure of said front cover to define at least one backing retention tab that engages said backing remote from said backing flap demarcation, and wherein said front cover is formed with parallel top and bottom edges and said backing flap demarcation is located at one of said top and bottom edges and said at least one backing retention tab is defined at the other of said top and bottom edges.

8. A document folder according to claim 5 wherein said title backing is formed of a sheet of stock separate from said cover stock and said title display means further includes a pocket defined on said interior surface of said front cover for receiving said backing therein with said title sheet mounted on said backing by said title sheet mounting tabs and disposed to face said interior surface of said front cover.

9. A document folder comprising:

a sheet of stiff cover stock folded to define front and back covers hinged together at a spine, wherein said front cover has an exterior surface and an opposite interior surface and including at least one window through said front cover defined entirely within the perimeter of said front cover;

a stiff, flat title backing no greater in size than said front cover;

a title sheet bearing an organization indicia printed thereon interposed between said interior surface of said front cover and said backing;

backing retention means for releasably holding said title backing in juxtaposition facing said interior surface of said front cover, whereby said printed organization indicia is visible through said window in said front cover from said exterior surface thereof; and title sheet mounting tabs formed by incisions through the structure of said backing whereby said title sheet mounting tabs are defined from said interior region of said backing and are resiliently deflectable outwardly from the remaining structure of said backing.

10. A document folder comprising:

a sheet of stiff cover stock folded to define front and back covers hinged together at a spine, wherein said front cover has an exterior surface and an opposite interior surface and including at least one window through said front cover defined entirely within the perimeter of said front cover;

a stiff, flat title backing no greater in size than said front cover;

a title sheet bearing printed matter thereon interposed between said interior surface of said front cover and said backing;

backing retention means for releasably holding said title backing in juxtaposition facing said interior surface of said front cover, whereby said printed matter is visible through said window in said front cover from said exterior surface thereof; and further characterized in that said front cover is rectangular in configuration having an interior region bounded by pairs of mutually parallel edges, and wherein said backing retention means is comprised of at least one backing retention tab located proximate at least one of said front cover edges and said at least one backing retention tab is formed by at least one incision through the structure of said front cover, and wherein said at least one backing retention tab is directed away from said at least one edge of said front cover, and said backing is formed as a flap of said stiff cover stock attached to said front cover and delineated therefrom by a linear backing flap demarcation located along an edge of said front cover parallel to the aforesaid one edge thereof.

* * * * *